US011843186B2

(12) United States Patent
Tan et al.

(10) Patent No.: US 11,843,186 B2
(45) Date of Patent: Dec. 12, 2023

(54) ANTENNA MODULE AND ELECTRONIC DEVICE

(71) Applicant: PEGATRON CORPORATION, Taipei (TW)

(72) Inventors: Hau Yuen Tan, Taipei (TW); Chao-Hsu Wu, Taipei (TW); Chien-Yi Wu, Taipei (TW); Shih-Keng Huang, Taipei (TW); Cheng-Hsiung Wu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 114 days.

(21) Appl. No.: 17/691,973

(22) Filed: Mar. 10, 2022

(65) Prior Publication Data

US 2022/0344814 A1 Oct. 27, 2022

(30) Foreign Application Priority Data

Apr. 23, 2021 (TW) ..... 110114719

(51) Int. Cl.

| | |
|---|---|
| ***H01Q 5/35*** | (2015.01) |
| ***H01Q 1/48*** | (2006.01) |
| ***H01Q 1/36*** | (2006.01) |
| ***H01Q 1/50*** | (2006.01) |
| ***H01Q 21/24*** | (2006.01) |
| ***H01Q 9/42*** | (2006.01) |

(52) U.S. Cl.

CPC ..... *H01Q 5/35* (2015.01); *H01Q 1/48* (2013.01)

(58) Field of Classification Search

CPC ..... H01Q 9/42; H01Q 1/243; H01Q 21/28; H01Q 1/38; H01Q 5/378; H01Q 5/371; H01Q 1/48; H01Q 5/328; H01Q 5/35

See application file for complete search history.

(56) References Cited

U.S. PATENT DOCUMENTS

2005/0083234 A1* 4/2005 Poilasne ..... H03F 1/56 343/700 MS

2008/0266202 A1 10/2008 Lin et al.

FOREIGN PATENT DOCUMENTS

CN 111641028 9/2020

* cited by examiner

*Primary Examiner* — Wei (Victor) Y Chan

(74) *Attorney, Agent, or Firm* — J.C. PATENTS

(57) ABSTRACT

An antenna module includes first, second, third antenna radiators, and first, second, third ground radiators. The first antenna radiator includes a first feeding terminal. The second antenna radiator extends from the first antenna radiator. The third antenna radiator extends from the first feeding terminal. The first ground radiator is disposed beside the first and second antenna radiators. A first coupling gap exists between the first ground radiator and the first and second antenna radiators. The second ground radiator is disposed beside the second antenna radiator. A second coupling gap exists between the second ground radiator and the second antenna radiator. The third ground radiator is disposed beside the first and second antenna radiators. A third coupling gap exists between the third ground radiator and the first antenna radiator. A fourth coupling gap exists between the third ground radiator and the second antenna radiator.

10 Claims, 9 Drawing Sheets

ANTENNA MODULE AND ELECTRONIC DEVICE

CROSS-REFERENCE TO RELATED APPLICATION

This application claims the priority benefit of Taiwan application serial no. 110114719, filed on Apr. 23, 2021. The entirety of the above-mentioned patent application is hereby incorporated by reference herein and made a part of this specification.

BACKGROUND

Technology Field

The disclosure relates to an antenna module and an electronic device, and more particularly to a multi-frequency antenna module and an electronic device having the antenna module.

Description of the Related Art

How to have a well-performing multi-frequency antenna module is the current direction of exploration.

SUMMARY

The disclosure provides an antenna module having the characteristics of multiple frequency bands.

The disclosure provides an electronic device having the antenna module.

An antenna module of the disclosure includes a first antenna pattern. The first antenna pattern includes a first antenna radiator, a second antenna radiator, a third antenna radiator, a first ground radiator, a second ground radiator, and a third ground radiator. The first antenna radiator includes a first feeding terminal. The second antenna radiator extends from the first antenna radiator. The third antenna radiator extends from the first feeding terminal in a direction away from the second antenna radiator. The first ground radiator is disposed beside the first antenna radiator and the second antenna radiator, and a first coupling gap exists between the first ground radiator and the first antenna radiator and the second antenna radiator. The second ground radiator is disposed beside the second antenna radiator, and a second coupling gap exists between the second ground radiator and the second antenna radiator. The third ground radiator is disposed beside the first antenna radiator and the second antenna radiator. A third coupling gap exists between the third ground radiator and the first antenna radiator. A fourth coupling gap exists between the third ground radiator and the second antenna radiator. The first antenna radiator and the third ground radiator resonate at a first frequency band and a second frequency band via the third coupling gap. A portion of the first antenna radiator, the second antenna radiator, and the third ground radiator resonate a third frequency band and a fourth frequency band via the fourth coupling gap. The third antenna radiator resonates at a fifth frequency band and a sixth frequency band.

In an embodiment of the disclosure, the first antenna pattern further includes a fourth antenna radiator extending from the second antenna radiator and located beside the third ground radiator, and a fifth coupling gap exists between the third ground radiator and the fourth antenna radiator.

In an embodiment of the disclosure, the first ground radiator includes a first ground terminal, and the first ground terminal is floating with respect to a system ground plane.

In an embodiment of the disclosure, the second ground radiator includes a second ground terminal, and a capacitor is connected in series between the second ground terminal and a system ground plane.

In an embodiment of the disclosure, the third ground radiator includes a third ground terminal, a capacitor is connected in series between the third ground terminal and a system ground plane, and the third ground terminal is connected to a specific absorption rate (SAR) sensor circuit.

In an embodiment of the disclosure, the third ground radiator includes a clearance hole located inside.

In an embodiment of the disclosure, the antenna module further includes a second antenna pattern separated from the first antenna pattern by a distance, and the distance is between 10 mm and 30 mm. The second antenna pattern includes a fifth antenna radiator and a fourth ground radiator. The fifth antenna radiator includes a second feeding terminal. The fourth ground radiator is disposed beside the fifth antenna radiator and includes a fourth ground terminal.

An electronic device of the disclosure includes a housing, a bracket, and an antenna module. The housing includes a narrow frame area. The bracket is disposed in the housing and located at the narrow frame area. The antenna module is disposed on a plurality of surfaces of the bracket. The antenna module includes a first antenna pattern. The first antenna pattern includes a first antenna radiator, a second antenna radiator, a third antenna radiator, a first ground radiator, a second ground radiator, and a third ground radiator. The first antenna radiator includes a first feeding terminal. The second antenna radiator extends from the first antenna radiator. The third antenna radiator extends from the first feeding terminal in a direction away from the second antenna radiator. The first ground radiator is disposed beside the first antenna radiator and the second antenna radiator, and a first coupling gap exists between the first ground radiator and the first antenna radiator and the second antenna radiator. The second ground radiator is disposed beside the second antenna radiator, and a second coupling gap exists between the second ground radiator and the second antenna radiator. The third ground radiator is disposed beside the first antenna radiator and the second antenna radiator. A third coupling gap exists between the third ground radiator and the first antenna radiator. A fourth coupling gap exists between the third ground radiator and the second antenna radiator. The first antenna radiator and the third ground radiator resonate at a first frequency band and a second frequency band via the third coupling gap. A portion of the first antenna radiator, the second antenna radiator, and the third ground radiator resonate a third frequency band and a fourth frequency band via the fourth coupling gap. The third antenna radiator resonates at a fifth frequency band and a sixth frequency band.

In an embodiment of the disclosure, the electronic device further includes a screen metal member disposed in the housing and located beside the antenna module, wherein the first antenna pattern is stepped at a portion facing the screen metal member.

In an embodiment of the disclosure, the electronic device further includes a metal back cover close to the third ground radiator of the first antenna pattern, and a sixth coupling gap is formed between the metal back cover and the third ground radiator.

Based on the above, the second antenna radiator of the antenna module of the disclosure extends from the first antenna radiator. The third antenna radiator extends from the first feeding terminal in a direction away from the second antenna radiator. The first ground radiator is disposed beside the first antenna radiator and the second antenna radiator, and a first coupling gap exists between the first ground radiator and the first antenna radiator and the second antenna radiator. The second ground radiator is disposed beside the second antenna radiator, and a second coupling gap exists between the second ground radiator and the second antenna radiator. The third ground radiator is disposed beside the first antenna radiator and the second antenna radiator. A third coupling gap exists between the third ground radiator and the first antenna radiator. A fourth coupling gap between the third ground radiator and the second antenna radiator. Via the above design, the first antenna radiator and the third ground radiator resonate at a first frequency band and a second frequency band via the third coupling gap. A portion of the first antenna radiator, the second antenna radiator, and the third ground radiator resonate at a third frequency band and a fourth frequency band via the fourth coupling gap. The third antenna radiator resonates at a fifth frequency band and a sixth frequency band. Therefore, the antenna module of the disclosure may have multi-frequency characteristics.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
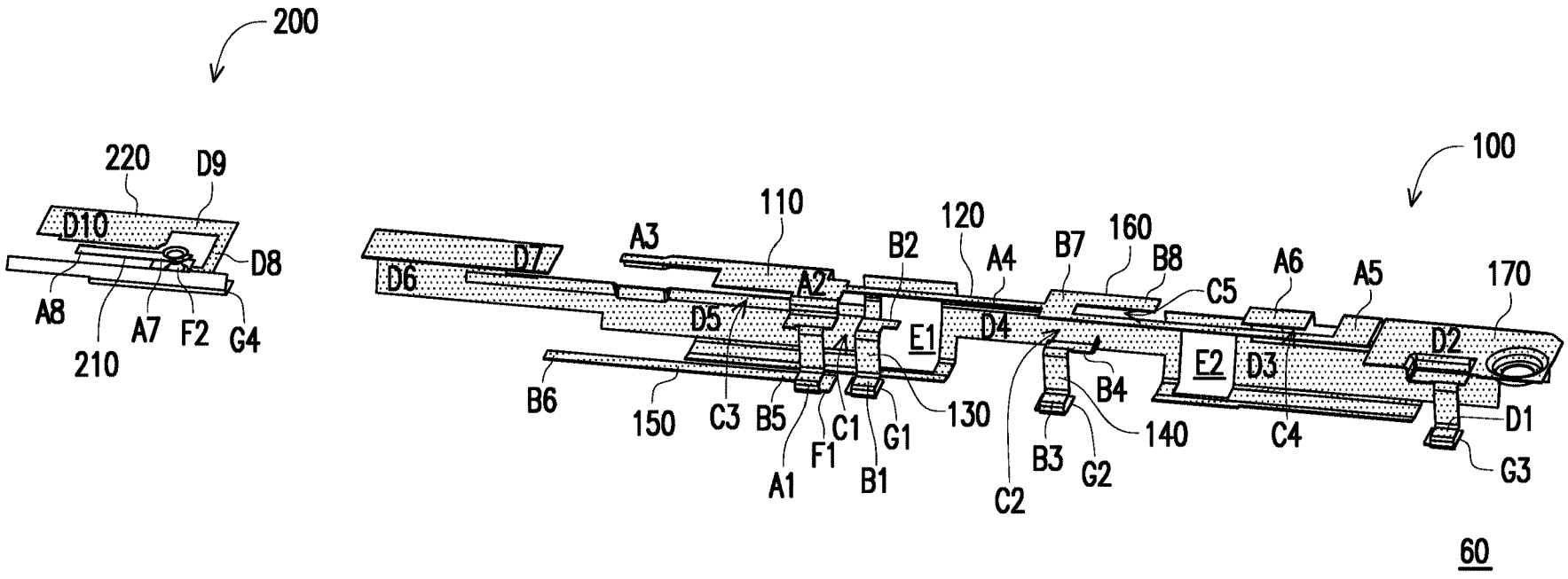
FIG. 1 is a schematic diagram of an antenna module according to an embodiment of the disclosure.

FIG. 1 is a schematic diagram of an antenna module according to an embodiment of the disclosure. Please refer to FIG. 1. In the present embodiment, an antenna module 60 includes a first antenna pattern 100 and a second antenna pattern 200. The first antenna pattern 100 is, for example, an LTE antenna, and the second antenna pattern 200 is, for example, a WiFi antenna, but the antenna module 60 is not limited thereto. As may be seen from FIG. 1, in the present embodiment, the antenna module 60 has a stereoscopic shape, and its width may be reduced to be installed in a space with a narrow frame and a limited size, and a multi-frequency effect may be provided.

Figure 2:
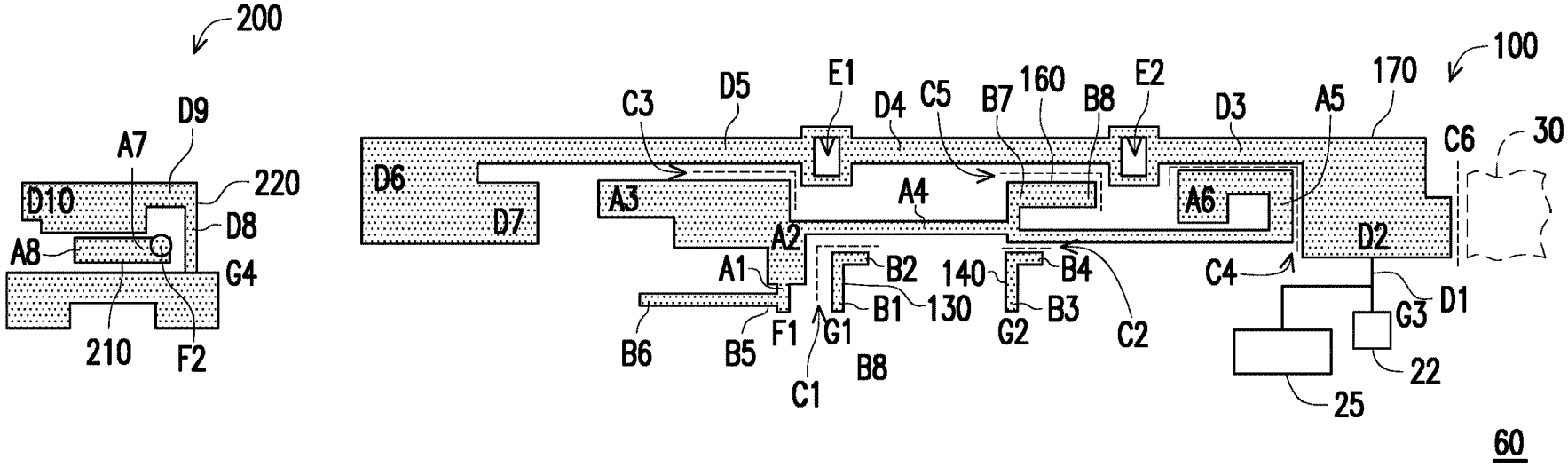
FIG. 2 is a simple development drawing of the antenna module of FIG. 1.

Since the shape of the stereoscopic antenna module 60 is complicated, in order to show it more clearly, FIG. 2 is a simple development drawing of the antenna module of FIG. 1, in order to facilitate the understanding of the relative relationship between the radiators. FIG. 3 to FIG. 6 are schematic diagrams of the antenna module of FIG. 1 in different angles when the antenna module of FIG. 1 is mounted on a bracket 10 of an electronic device.

Figure 3:
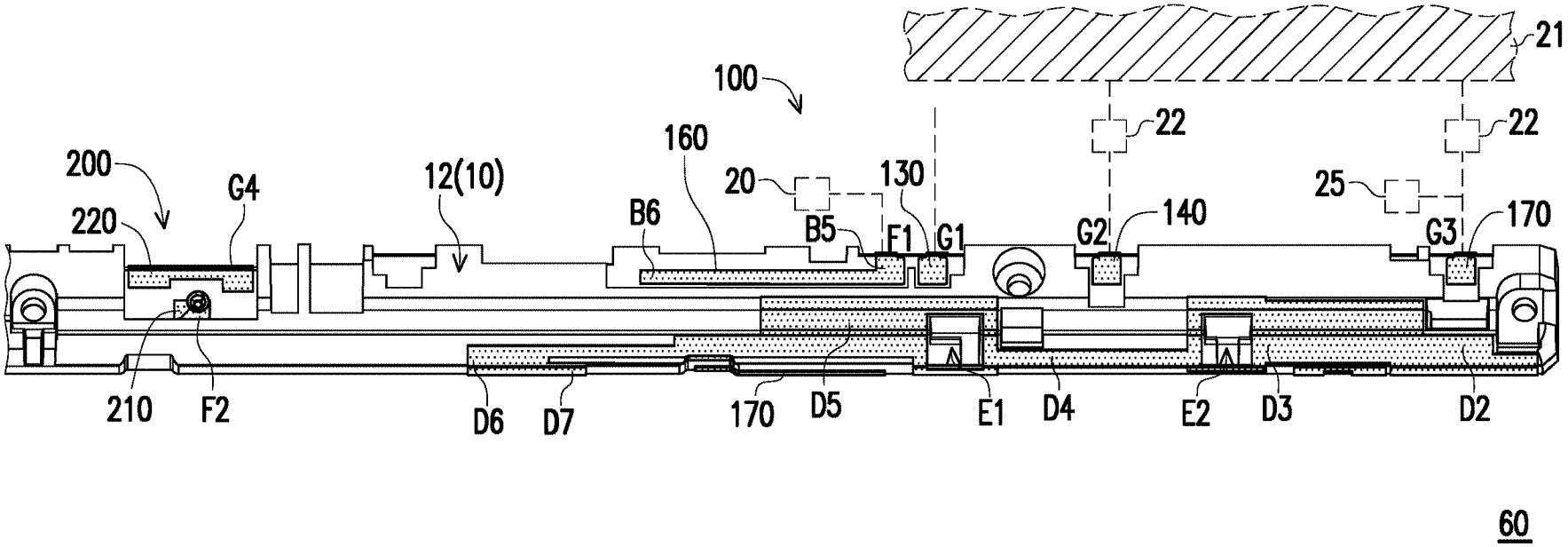
FIG. 3 to FIG. 6 are schematic diagrams of the antenna module of FIG. 1 in different angles when the antenna module of FIG. 1 is mounted on a bracket of an electronic device.
Figure 4:
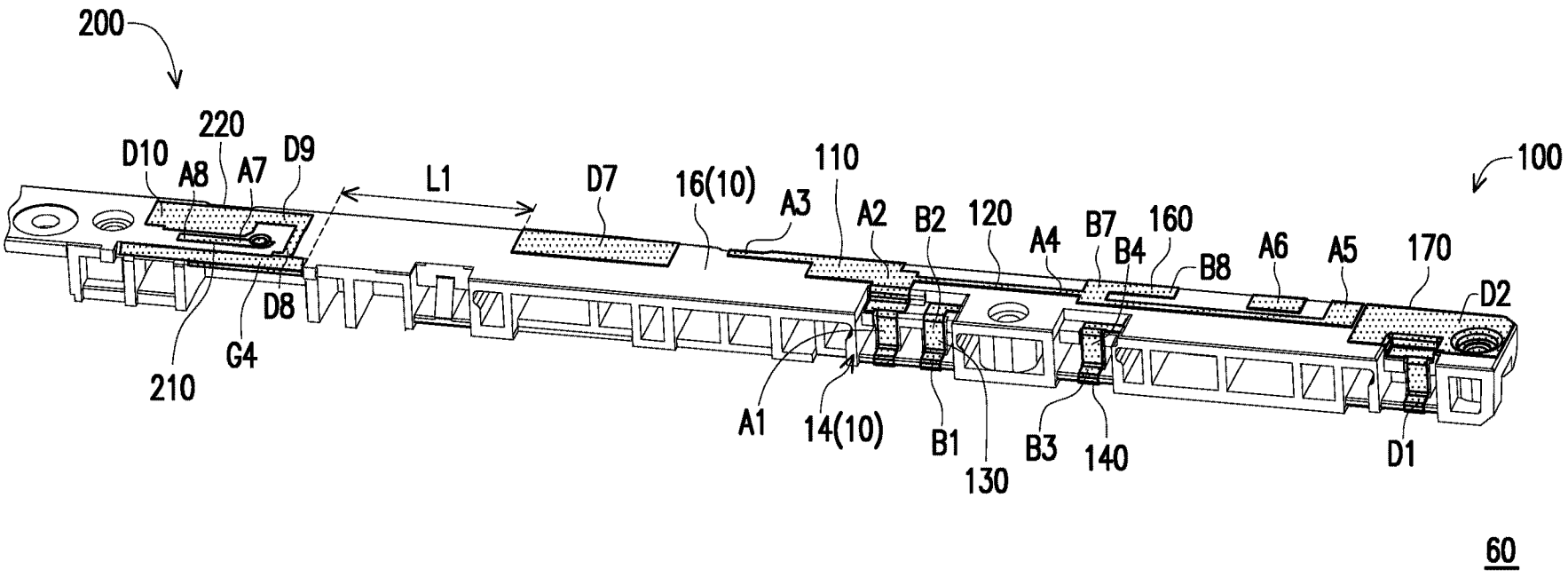
Figure 5:
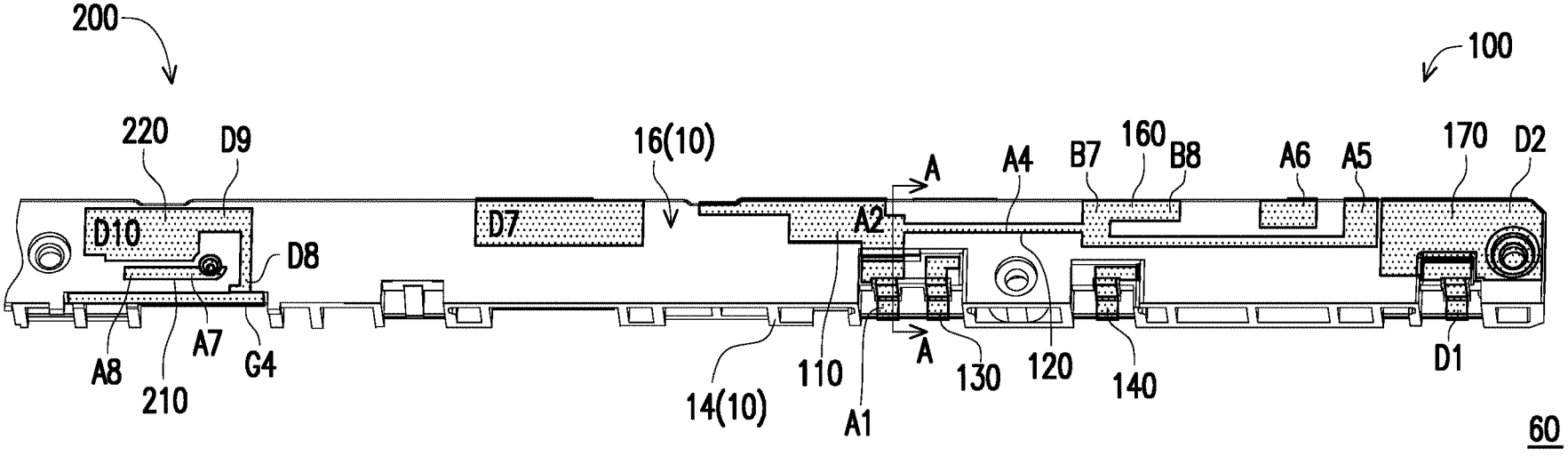
Figure 6:
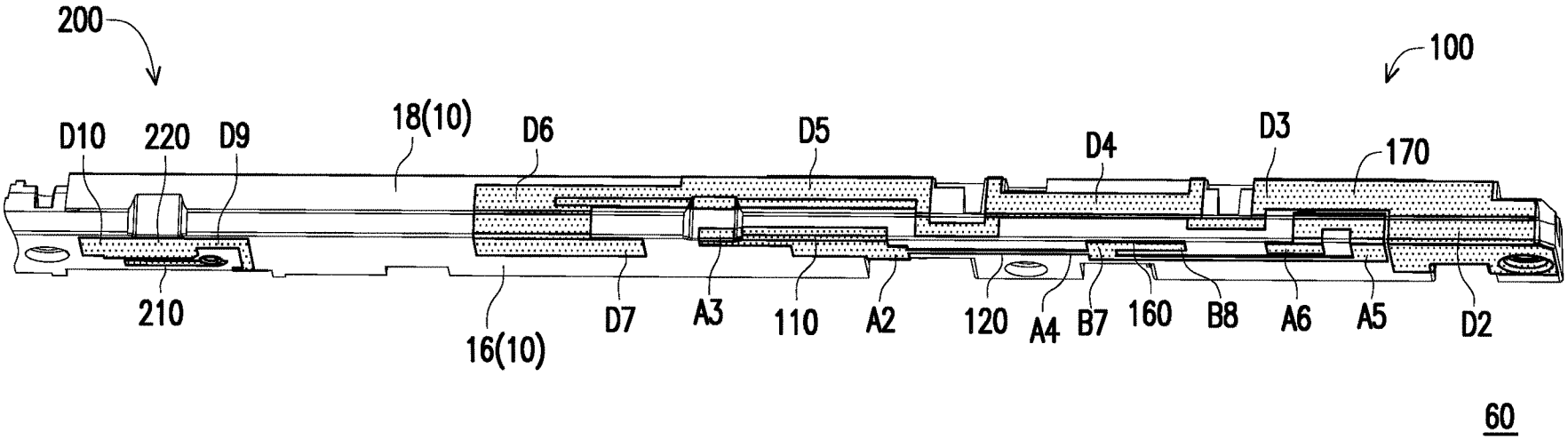

The stereoscopic antenna module 60 may be formed on the bracket 10 (labeled in FIG. 3) of the electronic device (labeled in FIG. 7) by a method such as a laser direct structuring (LDS) technique, flexible circuit board, or copper foil attachment, and may be distributed on a plurality of surfaces of the bracket 10. FIG. 3 shows a bottom surface 12 of the bracket 10. FIG. 4 shows a first lateral surface 14 and a top surface 16 of the bracket 10. FIG. 5 shows the top surface 16 of the bracket 10. FIG. 6 shows a second lateral surface 18 of the bracket 10. In an embodiment of the disclosure, the material of the bracket 10 of the electronic device may be plastic.

Please refer to FIG. 1 to FIG. 6 together. In the present embodiment, the first antenna pattern 100 includes a first antenna radiator 110 (positions F1, A1 to A3), a second antenna radiator 120 (positions A2, A4 to A6), a third antenna radiator 150 (positions F1, B5, B6), a first ground radiator 130 (positions G1, B1, B2), a second ground radiator 140 (positions G2, B3, B4), and a third ground radiator 170 (positions G3, D1 to D7).

As shown in FIG. 1, the first antenna radiator 110 (positions F1, A1 to A3), the second antenna radiator 120 (positions A2, A4 to A6), the third antenna radiator 150 (positions F1, B5, B6), the first ground radiator 130 (positions G1, B1, B2), the second ground radiator 140 (positions G2, B3, B4), and the third ground radiator 170 (positions G3, D1 to D7) are stereoscopic architectures.

The first antenna radiator 110 (position F1, A1 to A3) includes a first feeding terminal (position F1). The second antenna radiator 120 (positions A2, A4 to A6) extends from the first antenna radiator 110. It may be seen from FIG. 2 that the extending direction (right) of the sections of the second antenna radiator 120 at positions A2 and A4 is opposite to the extending direction (left) of the sections of the first antenna radiator 110 at positions A2 and A3. The third antenna radiator 150 (positions F1, B5, B6) extends from the first feeding terminal (position F1) and away from the second antenna radiator 120 to the left.

The first ground radiator 130 (positions G1, B1, B2) is in an inverted L shape and is disposed beside the first antenna radiator 110 and the second antenna radiator 120, and the first ground radiator 130 forms a first coupling gap C1 with the sections of the first antenna radiator 110 at positions A1 and A2 and the sections of the second antenna radiator 120 at positions A2 and A4. The first ground radiator 130 includes a first ground terminal (position G1).

The second ground radiator 140 (positions G2, B3, B4) is in an inverted L shape, and is disposed beside the sections of the second antenna radiator 120 at positions A4 and A5, and there is a second coupling gap C2 between the second ground radiator 140 and the second antenna radiator 120. The second ground radiator 140 includes a second ground terminal (position G2).

The third ground radiator 170 (positions G3, D1 to D7) is disposed beside the first antenna radiator 110 and the second antenna radiator 120. It may be seen from FIG. 2 that the third ground radiator 170 (positions G3, D1 to D7) is close to an inverted U shape, and the first antenna radiator 110 and the second antenna radiator 120 are located in the inverted U shape. The third ground radiator 170 includes a third ground terminal (position G3). In addition, the third ground radiator 170 includes clearance holes E1 and E2 configured internally for passage of mechanical members (such as hooks). The width of the third ground radiator 170 beside the clearance holes E1 and E2 is about 1 mm.

There is a third coupling gap C3 between the section of the third ground radiator 170 at position D5 and the sections of the first antenna radiator 110 at positions A2 and A3, and there is a fourth coupling gap C4 between the sections of the third ground radiator 170 at positions D2 and D3 and the sections of the second antenna radiator 120 at positions A5 and A6.

In the present embodiment, the first antenna radiator 110 (positions F1, A1 to A3) and the third ground radiator 170 (positions G3, D1 to D7) resonate at a first frequency band and a second frequency band via the third coupling gap C3. The first frequency band is, for example, 698 MHz, and the second frequency band is, for example, the double frequency of the first frequency band, 1710 MHz. The path of the fourth ground radiator 220 at positions D6 and D7 is a low-frequency extension path. In an embodiment, the first antenna radiator 110 (positions F1, A1 to A3) and the third ground radiator 170 (positions G3, D1 to D7) may further resonate at a triple frequency of the first frequency band via the third coupling gap C3.

In addition, the width of the sections of the first antenna radiator 110 at positions A2 and A3 may be adjusted to adjust the impedance matching and the position of the resonance frequency point of the second frequency band (1710 MHz). In addition, the width of the first coupling gap C1 may be adjusted to adjust low-frequency impedance matching.

A portion (positions A1, A2) of the first antenna radiator 110, the second antenna radiator 120 (positions A2, A4 to A6), and the third ground radiator 170 (positions G3, D1 to D7) resonate at a third frequency band and a fourth frequency band via the fourth coupling gap C4. The third frequency band is 960 MHz, and the fourth frequency band is the double frequency of the third frequency band, 1900 MHz. In an embodiment, the second antenna radiator 120 (positions A5 to A6) and the third ground radiator 170 (positions D1 and D3) may further resonate at a triple frequency of the third frequency band via the fourth coupling gap C4.

The width of the fourth coupling gap C4 between the sections of the second antenna radiator 120 at positions A5 and A6 and the sections of the third ground radiator 170 at positions D2 and D3 and the width of the sections of the third ground radiator 170 at positions D2 and D3 may be adjusted, so as to adjust the impedance matching of the third frequency band (960 MHz) and the position of the resonance frequency point.

The third antenna radiator 150 (positions F1, B5, B6) resonates at a fifth frequency band and a sixth frequency band. The fifth frequency band is, for example, 2500 MHz to 2690 MHz, and the sixth frequency band is, for example, the double frequency of the fifth frequency band, that is, the LAA high frequency band (5500 MHz to 5925 MHz). The width of the third antenna radiator 150 (positions F1, B5, B6) may be adjusted to adjust the impedance matching of the fifth frequency band and the sixth frequency band. In addition, the width of the second coupling gap C2 may be adjusted to adjust the impedance matching between 2500 MHz and 2690 MHz.

Moreover, the first antenna pattern 100 further includes a fourth antenna radiator 160 (positions B7, B8) extending from the portion of the second antenna radiator 120 at position A4 and located between positions D3 and D4 of the third ground radiator 170. There is a fifth coupling gap C5 between the third ground radiator 170 at position D4 and the fourth antenna radiator 160. The width of the fifth coupling gap C5 may be adjusted to adjust the impedance matching of 1700 MHz to 2700 MHz and the doubled LAA high frequency band (5150 MHz to 5500 MHz).

Moreover, referring to FIG. 3, the first feeding terminal (position F1), the first ground terminal (position G1), the second ground terminal (position G2), and the third ground terminal (position G3) of the first antenna pattern 100 (LTE antenna) are disposed at the bottom surface 12 of the bracket 10.

In the present embodiment, the circuit board of the electronic device may be provided with a plurality of elastic members (not shown) directly connected with the first feeding terminal (position F1), the first ground terminal (position G1), the second ground terminal (position G2), and the third ground terminal (position G3). The first feeding terminal (position F1) may be electrically connected to a radio frequency signal terminal 20 via the elastic members. The first ground terminal (position G1) may float with respect to a system ground surface 21 (for example, the ground surface of the motherboard) via the elastic members. A capacitor 22 (2.2 pF) is connected in series between the second ground terminal (position G2) and the system ground plane 21. In other words, the second ground terminal (position G2) is connected to the ground of the capacitor 22.

Similarly, another capacitor 22 (2.2 pF) is connected in series between the third ground terminal (position G3) and the system ground plane 21 to improve low-frequency impedance matching. In addition, the third ground terminal is connected to a specific absorption rate (SAR) sensor circuit 25 to form a hybrid antenna. The specific absorption rate (SAR) sensor circuit 25 is configured to detect the distance of an object, and reduce the transmission power when the object is close so as to meet the SAR test specification.

In the present embodiment, the size of the first antenna pattern 100 is limited due to the relatively small configuration space. The specific absorption rate (SAR) sensor circuit 25 is designed on the motherboard (not shown), not disposed on the first antenna pattern 100. The first antenna pattern 100 is connected to the motherboard via the third ground terminal (position G3) and the elastic members, so as to be connected to the specific absorption rate (SAR) sensor circuit 25. In this way, the design of the specific absorption rate (SAR) sensor circuit 25 on the motherboard may free up more space for the first antenna pattern 100 to use.

Therefore, the first antenna pattern 100 (LTE antenna) may resonate at low, medium, and high frequency bands via the above design, and may have good impedance matching at the low, medium, and high frequencies.

In addition, the second antenna pattern 200 (Wi-Fi antenna) includes a fifth antenna radiator 210 (positions F2, A7, A8) and a fourth ground radiator 220 (positions G4, D8 to D10). The fifth antenna radiator 210 includes a second feeding terminal (position F2). The fourth ground radiator 220 is disposed beside the fifth antenna radiator 210 and surrounds the fifth antenna radiator 210. The fourth ground radiator 220 includes a fourth ground terminal (position G4). In the present embodiment, the second antenna pattern 200 may resonate at two frequency bands of 2400 MHz to 2500 MHz and 5150 MHz to 5875 MHz.

It may be seen from FIG. 2 that the ground paths of the fourth ground radiator 220 at positions D8 to D10 and the third ground radiator 170 at positions D1 to D7 all face the left side of FIG. 2 (in the present embodiment, the left side is the inner side of the device). Such a design may improve the isolation between the first antenna pattern 100 and the second antenna pattern 200.

It may be seen from FIG. 4 that there is a distance L1 between the first antenna pattern 100 (LTE antenna) and the second antenna pattern 200 (Wi-Fi antenna), and the distance L1 is between about 10 mm to 30 mm, for example, 15 mm.

In addition, it may be seen on the left side of FIG. 3 that the second feeding terminal and the fourth grounding terminal of the second antenna pattern 200 are disposed at the bottom surface 12 of the bracket 10. The second feeding terminal may be connected to the positive terminal of a coaxial transmission line (not shown) to be connected to the system signal terminal. The fourth ground terminal may be connected to the negative terminal of the coaxial transmission line to be connected to the ground plane.

Figure 7:
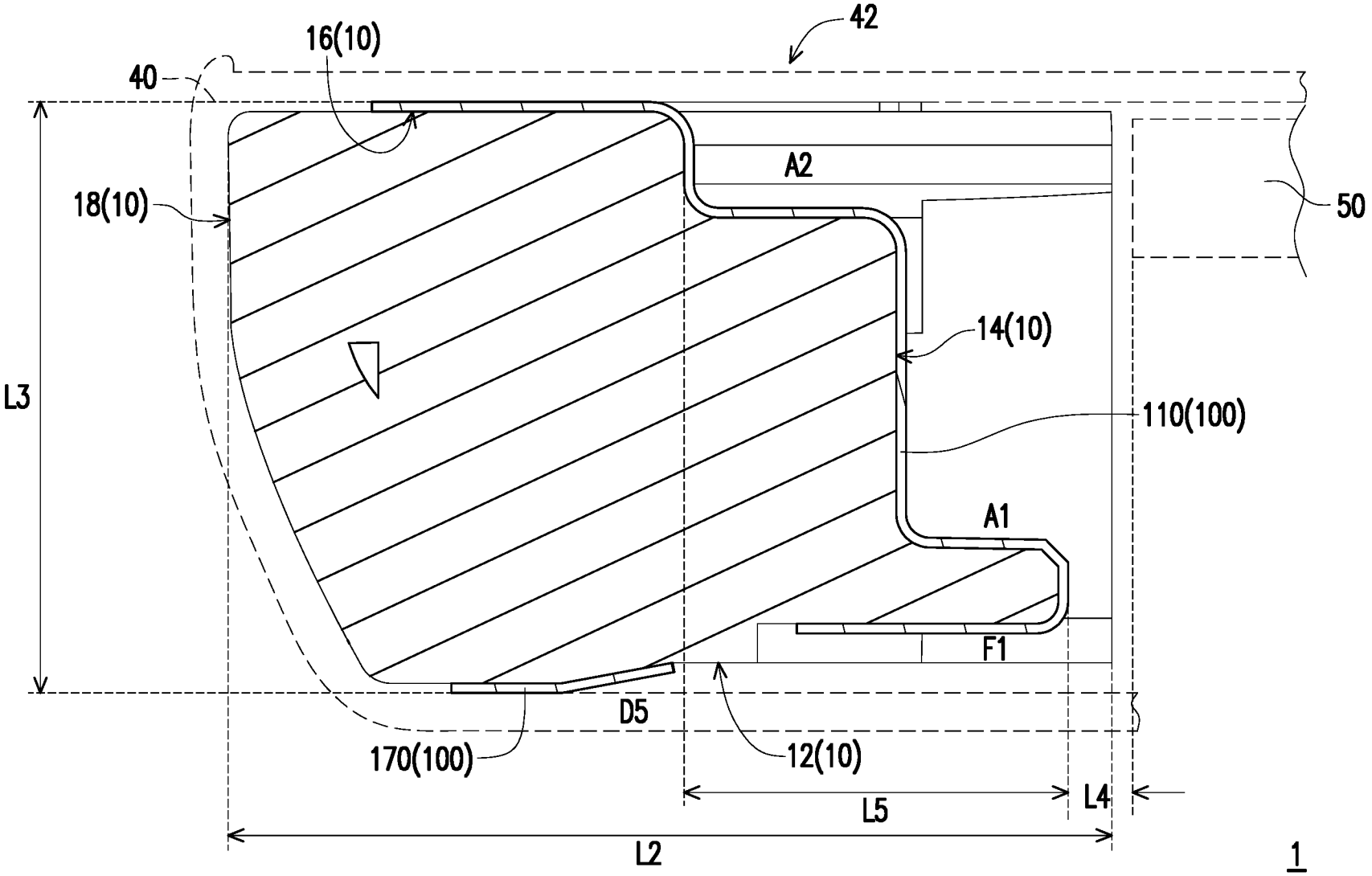
FIG. 7 is a partial side cross-sectional view of an electronic device according to an embodiment of the disclosure.

FIG. 7 is a partial side cross-sectional view of an electronic device according to an embodiment of the disclosure, wherein the cross section corresponds to the A-A line section of FIG. 5. In other words, the cross section of the antenna module 60 and the bracket 10 shown in FIG. 7 is the A-A line section of FIG. 5. Please refer to FIG. 7. In the present embodiment, the electronic device 1 is, for example, a tablet computer, but is not limited thereto.

The electronic device 1 includes a housing 40, the bracket 10 of FIG. 3, the antenna module 60 (marked in FIG. 3), and a screen metal member 50. The housing 40 includes a narrow frame area 42. The bracket 10 is disposed in the housing 40 and located at the narrow frame area 42. The antenna module 60 is disposed on the bottom surface 12, the first lateral surface 14, the top surface 16, and the second lateral surface 18 of the bracket 10. The screen metal member 50 is disposed in the housing 40 and located beside the antenna module 60.

In the present embodiment, the size of the available space of the first antenna pattern 100 is about 79 mm in length, 7.92 mm in width (L2), and 4.98 mm in height (L3). The narrow frame area 42 may provide limited space for the antenna module 60 to be configured. In the present embodiment, the antenna module 60 is disposed on the bracket 10 stereoscopically, thereby reducing the size in width.

Moreover, since the antenna module 60 (the first antenna pattern 100 is shown in FIG. 7) needs to have a spacing L4 from the screen metal member 50, the spacing L4 should be greater than or equal to 1 mm to reduce the influence of the screen metal member 50 on the antenna module 60. In the present embodiment, a portion of the first antenna pattern 100 is stepped to increase the distance from the screen metal member 50 so as to reduce interference. In the present embodiment, a lateral distance L5 between the portion of the first antenna pattern 100 which has the same height as the screen metal member 50 (that is, the top of the step) and the bottom of the step is about 3.92 mm. Therefore, such a stepped design may strive for more distance between the first antenna pattern 100 and the screen metal member 50.

In addition, since the screen metal member 50 is located beside the first lateral surface 14 of the bracket 10, the first antenna pattern 100 (LTE antenna) disposed beside the first lateral surface 14 adopts the stepped design. Specifically, returning to FIG. 4, the sections of the first antenna radiator 110 at positions A1, A2, the sections of the first ground radiator 130 at positions B1, B2, the sections of the second ground radiator 140 at positions B3, B4, and the sections of the third ground radiator 170 at positions D1, D2 all adopt the stepped design.

Furthermore, in the present embodiment, the electronic device 1 further includes a metal back cover 30 (FIG. 2) close to the third ground radiator 170 of the first antenna pattern 100. A sixth coupling gap C6 is formed between the metal back cover 30 and the third ground radiator 170. The sixth coupling gap C6 is between 0.5 mm and 1 mm.

Figure 8:
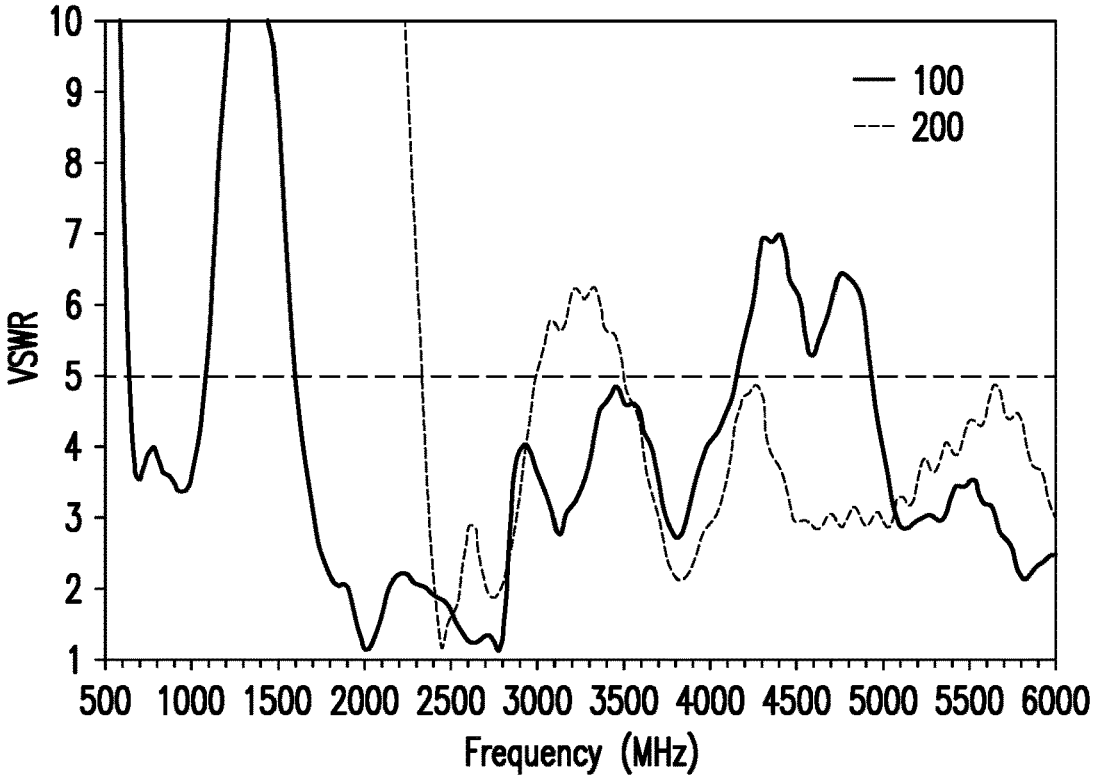
FIG. 8 is a plot oft frequency vs. VSWR for the antenna module of FIG. 1.

FIG. 8 is a plot of frequency vs. VSWR for the antenna module of FIG. 1. Please refer to FIG. 8. In the present embodiment, the VSWR of the first antenna pattern 100 may be less than or equal to 5 when the frequency is 698 MHz to 960 MHz. The VSWR of the first antenna pattern 100 and the second antenna pattern 200 at frequencies of 1710 MHz to 2700 MHz, 3300 MHz to 3800 MHz, and 5150 MHz to 5925 MHz may all be less than 4 with good performance.

Figure 9:
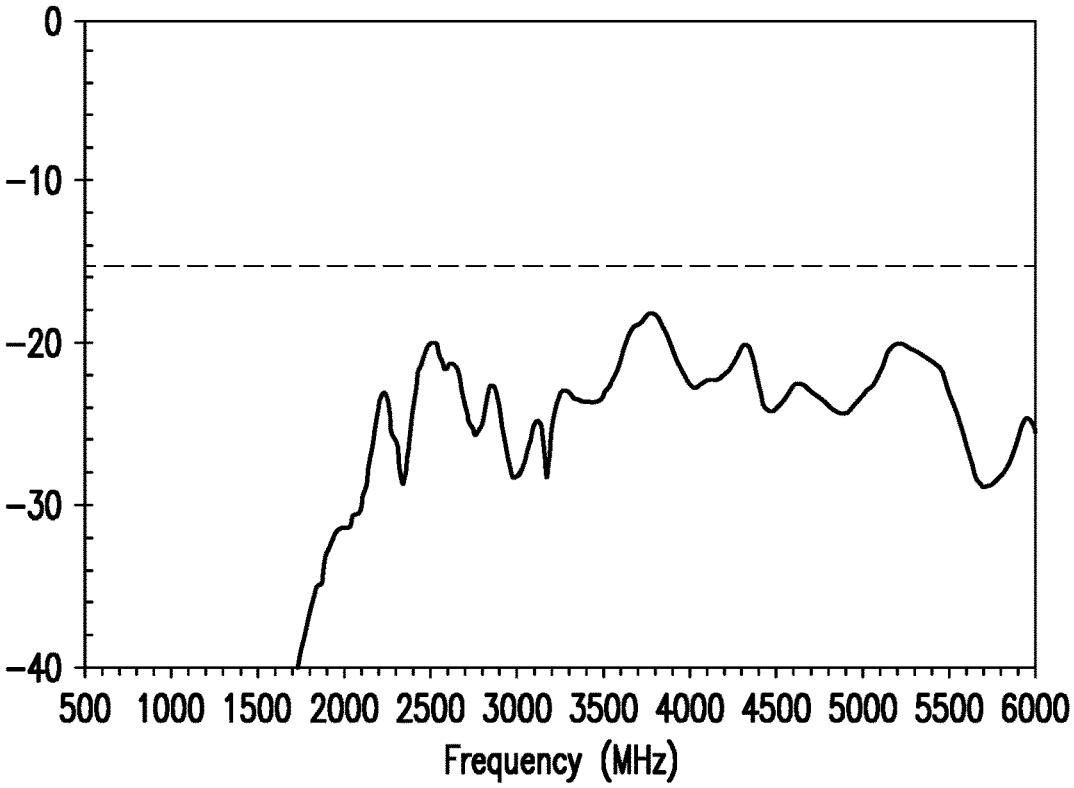
FIG. 9 is a plot of frequency vs. isolation for the antenna module of FIG. 1.

FIG. 9 is a plot of frequency vs. isolation for the antenna module of FIG. 1. Please refer to FIG. 9. In the present embodiment, the isolation between the first antenna pattern 100 and the second antenna pattern 200 may be less than −15 dB with good performance.

Figure 10:
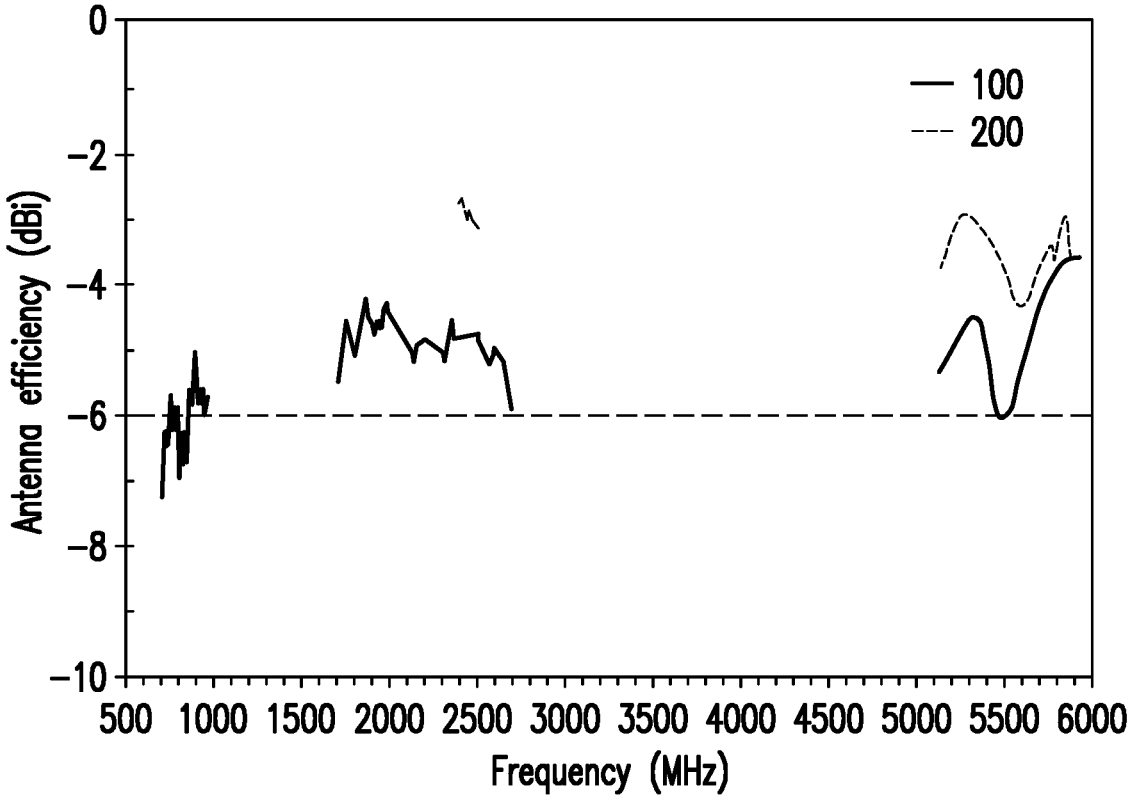
FIG. 10 is a plot of frequency vs. antenna efficiency for the antenna module of FIG. 1.

FIG. 10 is a plot of frequency vs. antenna efficiency for the antenna module of FIG. 1. Referring to FIG. 10, the first antenna pattern 100 (LTE antenna) has an antenna efficiency of −5.1 dBi to −7.3 dBi at a frequency of 698 MHz to 960 MHz, has an antenna efficiency of −4.2 dBi to −5.8 dBi at a frequency of 1710 MHz to 2700 MHz, and has an antenna efficiency of −3.6 dBi to −6.0 dBi at a frequency of 5150 MHz to 5925 MHz, thus achieving the performance of LTE broadband antenna efficiency.

The second antenna pattern 200 (Wi-Fi antenna) has an antenna efficiency of −2.7 dBi to −3.1 dBi at a frequency of 2400 MHz to 2500 MHz, and has an antenna efficiency of −3.0 dBi to −4.3 dBi at a frequency of 5150 MHz to 5875 MHz, thus achieving good performance.

Based on the above, the second antenna radiator of the antenna module of the disclosure extends from the first antenna radiator. The third antenna radiator extends from the first feeding terminal in a direction away from the second antenna radiator. The first ground radiator is disposed beside the first antenna radiator and the second antenna radiator, and a first coupling gap exists between the first ground radiator and the first antenna radiator and the second antenna radiator. The second ground radiator is disposed beside the second antenna radiator, and a second coupling gap exists between the second ground radiator and the second antenna radiator. The third ground radiator is disposed beside the first antenna radiator and the second antenna radiator. A third coupling gap exists between the third ground radiator and the first antenna radiator. A fourth coupling gap exists between the third ground radiator and the second antenna radiator. With the above design, the first antenna radiator and the third ground radiator resonate at a first frequency band and a second frequency band via the third coupling gap. A portion of the first antenna radiator, the second antenna radiator, and the third ground radiator resonate at a third frequency band and a fourth frequency band via the fourth coupling gap. The third antenna radiator resonates at a fifth frequency band and a sixth frequency band. Therefore, the antenna module of the disclosure may have multi-frequency characteristics.

What is claimed is:

1. An antenna module, comprising:

a first antenna pattern, comprising:

a first antenna radiator comprising a first feeding terminal;

a second antenna radiator extending from the first antenna radiator;

a third antenna radiator extending from the first feeding terminal in a direction away from the second antenna radiator;

a first ground radiator disposed beside the first antenna radiator and the second antenna radiator, a first coupling gap exists between the first ground radiator and the first antenna radiator and the second antenna radiator;

a second ground radiator disposed beside the second antenna radiator, a second coupling gap exists between the second ground radiator and the second antenna radiator; and a third ground radiator disposed beside the first antenna radiator and the second antenna radiator, a third coupling gap exists between the third ground radiator and the first antenna radiator, a fourth coupling gap exists between the third ground radiator and the second antenna radiator, the first antenna radiator and the third ground radiator resonate at a first frequency band and a second frequency band via the third coupling gap, a portion of the first antenna radiator, the second antenna radiator, and the third ground radiator resonate at a third frequency band and a fourth frequency band via the fourth coupling gap, the third antenna radiator resonates at a fifth frequency band and a sixth frequency band.

2. The antenna module of claim 1, wherein the first antenna pattern further comprises: a fourth antenna radiator extending from the second antenna radiator and located beside the third ground radiator, and t a fifth coupling gap exists between the third ground radiator and the fourth antenna radiator.

3. The antenna module of claim 1, wherein the first ground radiator comprises a first ground terminal, and the first ground terminal is floating with respect to a system ground plane.

4. The antenna module of claim 1, wherein the second ground radiator comprises a second ground terminal, and a capacitor is connected in series between the second ground terminal and a system ground plane.

5. The antenna module of claim 1, wherein the third ground radiator comprises a third ground terminal, a capacitor is connected in series between the third ground terminal and a system ground plane, and the third ground terminal is connected to a specific absorption rate (SAR) sensor circuit.

6. The antenna module of claim 1, wherein the third ground radiator comprises a clearance hole located inside.

7. The antenna module of claim 1, further comprising:

a second antenna pattern separated from the first antenna pattern by a distance, the distance is between 10 mm and 30 mm, and the second antenna pattern comprises:

a fifth antenna radiator comprising a second feeding terminal; and a fourth ground radiator disposed beside the fifth antenna radiator and comprising a fourth ground terminal.

8. An electronic device, comprising:

a housing comprising a narrow frame area;

a bracket disposed in the housing and located at the narrow frame area; and an antenna module disposed on a plurality of surfaces of the bracket, the antenna module comprising:

a first antenna pattern comprising:

a first antenna radiator comprising a first feeding terminal;

a second antenna radiator extending from the first antenna radiator;

a third antenna radiator extending from the first feeding terminal in a direction away from the second antenna radiator;

a first ground radiator disposed beside the first antenna radiator and the second antenna radiator, a first coupling gap exists between the first ground radiator and the first antenna radiator and the second antenna radiator;

a second ground radiator disposed beside the second antenna radiator, a second coupling gap exists between the second ground radiator and the second antenna radiator; and a third ground radiator disposed beside the first antenna radiator and the second antenna radiator, a third coupling gap exists between the third ground radiator and the first antenna radiator, a fourth coupling gap exists between the third ground radiator and the second antenna radiator, the first antenna radiator and the third ground radiator resonate at a first frequency band and a second frequency band via the third coupling gap, a portion of the first antenna radiator, the second antenna radiator, and the third ground radiator resonate at a third frequency band and a fourth frequency band via the fourth coupling gap, the third antenna radiator resonates at a fifth frequency band and a sixth frequency band.

9. The electronic device of claim 8, further comprising:

a screen metal member disposed in the housing and located beside the antenna module, wherein the first antenna pattern is stepped at a portion facing the screen metal member.

10. The electronic device of claim 8, further comprising:

a metal back cover close to the third ground radiator of the first antenna pattern, and a sixth coupling gap is formed between the metal back cover and the third ground radiator.

* * * * *